United States Patent [19]

Keller

[11] 4,063,586

[45] Dec. 20, 1977

[54] MOLD FORMING APPARATUS WITH MOLD FLASK STABILIZING MEANS

[75] Inventor: Franz Keller, Neuhausen am Rheinfall, Switzerland

[73] Assignee: Erwin Bührer, Schaffhausen, Switzerland

[21] Appl. No.: 764,954

[22] Filed: Feb. 2, 1977

[30] Foreign Application Priority Data

Feb. 2, 1976 Switzerland ..... 1273/76

[51] Int. Cl.[2] ..... B22C 15/08

[52] U.S. Cl. ..... 164/207; 164/37; 164/379; 164/394

[58] Field of Search ..... 164/37, 38, 39, 40, 164/169, 207, 208, 209, 210, 211, 212, 379, 382, 383, 394, 395, 396, 387, 381

[56] References Cited

U.S. PATENT DOCUMENTS

| | | | |
|---|---|---|---|
| 791,214 | 5/1905 | Rockwood | 164/394 |
| 1,784,995 | 12/1930 | Morris et al. | 164/212 |
| 3,695,339 | 10/1972 | Toccone | 164/213 |

FOREIGN PATENT DOCUMENTS

| | | | |
|---|---|---|---|
| 660,705 | 1938 | Germany | 164/383 |
| 440,568 | 12/1967 | Switzerland | 164/207 |

*Primary Examiner*—Ronald J. Shore
*Attorney, Agent, or Firm*—Toren, McGeady and Stanger

[57] ABSTRACT

A mold forming machine for the production of casting molds wherein molding sand is compressed within mold flasks is provided with stabilizing means for counteracting the effects of the compressive forces generated within the mold flask during compression of the molding sand tending to cause distortion of the flask. The stabilizing means include a movable frame which is adapted to extend about a molding flask placed in the machine with the frame being positioned relative to the flask by lifting gears which move the frame in accordance with the various stages of operation of the machine. A plurality of fluid pressure actuated tensioning elements are mounted on the frame to be movable therewith. The tensioning elements are adapted to apply compressive forces inwardly of the mold flasks during application of the molding sand compressing forces. Pressure devices for applying fluid pressure to the tensioning elements in order to effect application of the compressive forces against the mold flask operate to control the compressive forces applied by the tensioning elements so that the magnitude of these forces will be determined in relation to the magnitude of the forces applied by the molding sand compressing mechanism.

6 Claims, 6 Drawing Figures

MOLD FORMING APPARATUS WITH MOLD FLASK STABILIZING MEANS

BACKGROUND OF THE INVENTION

The present invention relates generally to mold forming apparatus and more particularly to a device for the production of casting molds. The invention is intended for utilization in molding machines including a mold compressing unit wherein sand contained in molding flasks is compressed during the mold forming procedure.

With increasing mechanization of the techniques and devices utilized for the production of casting molds in foundries, there has occured a substantial increase in the size of the molding boxes or flasks which are utilized. This has resulted in a considerable increase in the necessity for rigidity of the molding boxes or flasks. Due to the compression methods which are utilized, higher compressive forces can be achieved interiorly of the molding flask. However, this has resulted in greater pressure upon the inner walls of the molding flask during the sand compressing operation thereby, in turn, requiring much greater rigidity and stability of the molding flasks.

Presently known techniques and devices available for stiffening or stabilizing the configuration of the molding flasks do not always meet the optimum requirements for production of an acceptable casting mold. In extensive tests it has been found that partially inadmissable deformations occur particularly during the molding of patterns having a large volume. The causes of these deformations have been found to be a lack of rigidity or stability in the shape of the molding boxes when under high compressive forces applied to the molding sand.

Attempts at providing strengthing or stabilization of the configuration of the molding boxes or flasks have at times resulted in an unacceptable increase in the weight of the flask. This is undesirable from many aspects. Apart from the higher production costs which may be involved in such weight increase, there occurs a requirement for correspondingly larger dimensions in other parts of the molding machine, such as conveyor tracks, turning and covering devices, and the like which must be adapted to the larger and heavier molding flasks.

Accordingly, the need exists for insuring that the molding boxes or flasks may retain sufficient rigidity of stability of form without incurring the disadvantages which arise with prior art devices.

The present invention is directed toward providing such a device wherein the geometric form of the molding box or flask may be maintained stable both before, during and after the compression of the casting mold to be produced.

SUMMARY OF THE INVENTION

Briefly, the present invention may be described as a device for use in mold forming apparatus including means for compressing molding sand contained in mold flasks, the device of the present invention comprising stabilizing means for counteracting the effects of the compressive forces generated within the mold flasks during compression of the molding sand tending to cause distortion of the flasks, the stabilizing means comprising a movable frame adapted to extend about a molding flask placed in the apparatus for compression of molding sand contained therein, lifting gear for adjustably positioning the frame relative to a molding flask and a plurality of fluid pressure actuated tension elements mounted on the frame and movable therewith, the tension elements being adapted to apply compressive forces inwardly of the molding flask upon application to the tensioning elements of fluid pressure, with the pressure means being provided for applying fluid pressure to the tensioning elements in a manner to effect application of the compressive forces against the mold flasks in relation to the magnitude of the forces applied by the mold sand compressing means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
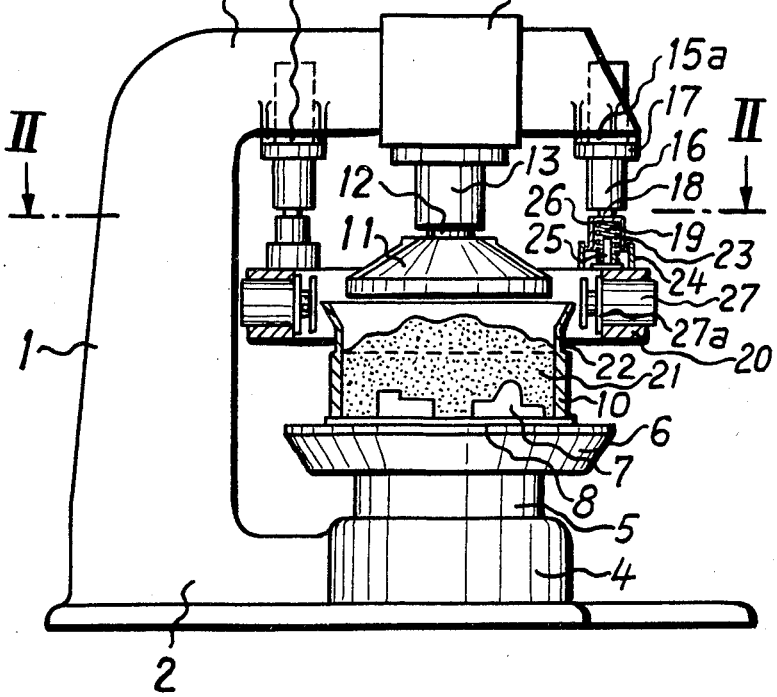
FIG. 1 is an elevational view partially in section of a device embodying the present invention, the view being taken along the line I—I of FIG. 2 showing the frame of the present invention in the raised position.

Referring now to the drawings, wherein like reference numerals refer to similar parts throughout the various figures thereof, there is represented in the drawings a molding machine embodying the present invention which consists of a housing 1 having a lower housing part 2 and an upper housing part 3. The lower housing part 2 is provided with a compression cylinder 4 having a compression piston 5 which is hydraulically or pneumatically operated. The upper end of the piston 5 is connected to a mold table 6 upon which there is changeably secured a pattern plate 8 equipped with patterns 7. Upon the pattern plate 8 there is attached a molding box or flask 10 provided with dowel bores 9, **9*a*, with the flask 10 being accurately held in a desired or centered position by a centering device arranged on the mold table 6. Depending upon the compression method which is used, a known holding-down device may be provided for the molding box 10**.

A press plate 11 which is adapted in its form and size to the inside cross section of the molding box 10 is arranged above the mold table 6 and the molding flask or box 10 about the same axis of symmetry as the compression cylinder 4. The press plate 11 may be raised and lowered by means of a hydraulic or pneumatic piston 12 operating within a fluid cylinder 13. The fluid cylinder 13 is detachably mounted in a receiver 14 arranged upon the upper housing part 3. In order to fill in molding material such as molding sand 21 within the molding flask 10, there is provided a sand frame 22 which is attached upon the molding flask 10. The compression cylinder 4, compression piston 5, mold table 6, pattern plate 8, press plate 11 and the feed cylinder 13 with the piston 12 all taken together form in joint arrangement a precompression unit.

Laterally of the feed cylinder 13 and arranged upon the upper housing part 3 there are provided beams 15, **15*a* which serve to receive lifting cylinders 16 of the hydraulic or pneumatic lifting gears 17. Piston rods 18 which are connected at their bottom ends over a pendulum device 19 to a frame 20 are inserted within the lifting cylinder 16. The frame 20 may be raised and lowered by means of the lifting gears 17 and it is held in an articulated manner by the pendulum device 19. Depending upon the size of the molding flask 10, one or more lifting gears 17** are provided for the vertical movements and in the present embodiment of the invention depicted and described herein four lifting gears are provided.

The pendulum device 19 utilized for the present invention involves the combination of a pot-shaped follower 23 connected to the piston rod 18 and a retaining ring 24 cooperating with the follower 23 in association with a spring element 26 inserted in the follower 23 and guided by a bolt 25. The follower 23 is provided with a projecting edge which is entrained by an inwardly projecting collar formed on the retaining ring 24. The retaining ring 24 and the bolt 25 are connected to the frame 20. The inserted spring element 26, which may preferably be a compression spring, bears with one end upon follower 23 and with the other end upon the frame 20. The frame 20 is designed as a form locking element which embraces or extends about the molding flask 10 and which includes pressure means 27 arranged on the circumference of the frame 20. The pressure means 27 are designed as pressure cylinders **27*a* having hydraulic or pneumatic pressure pistons 28 which act in the direction of the molding flask wall. The pressure means 27 and the lifting gears 17 are connected by means of conduits (not shown) which carry a fluid pressure medium to a central control system from which the compression cylinder 4 and the feed cylinder 13** are controlled.

The end of the pressure piston 28 protruding beyond the pressure cylinder **27*a* is articulated to a fluid pressure actuated tensioning element 29 which may be applied to the molding flask 10. Tensioning element 29** is designed in the form of a plate in order to transmit and absorb forces to and from the wall of the molding flask.

As will be apparent from the present description, the hydraulic or pneumatic pressure unit **27*a*, 28, 29** may also be configured as a mechanical or mechanical-pneumatic-hydraulic device. Furthermore, the device according to the present invention described and depicted herein may as well be utilized on an automatic molding machine having one or more molding stations instead of upon the molding machine which is referred to herein for the purposes of description of the invention.

Figure 2:
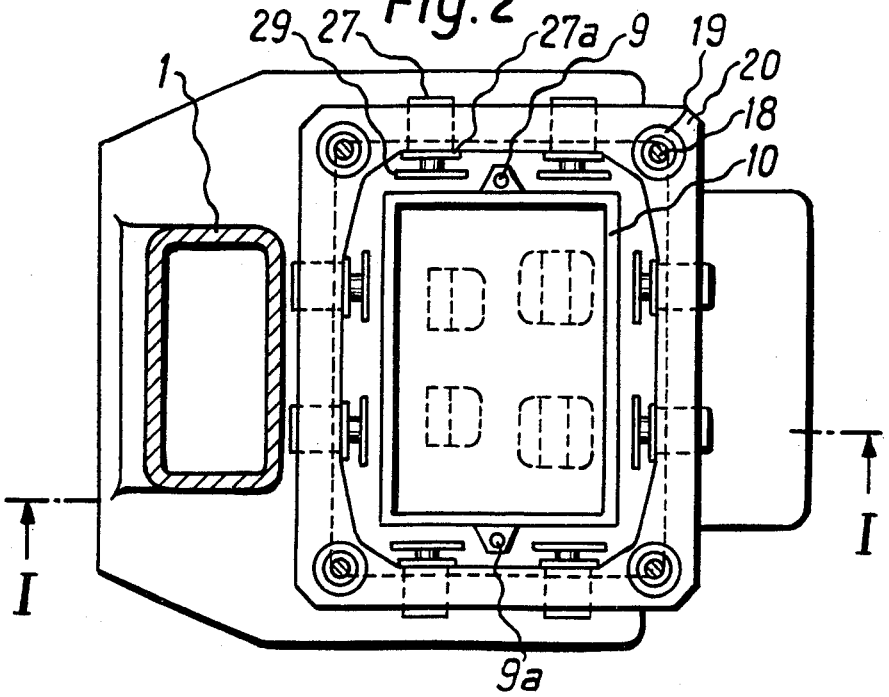
FIG. 2 is a top view of the device shown in FIG. 1 with the frame in the raised position, the view being a horizontal section of the molding machine embodying the present invention taken along the line II—II of FIG. 1.

In the operation of the embodiment of the present invention described herein, the compression piston 5 of the compression cylinder 4 is balanced at the start of a casting mold production procedure as indicated in FIGS. 1 and 2 by a controlled operation of a control device whereby the press plate 11 is brought by means of the piston 12 of the feed cylinder 13 above sand frame 22. The frame 20 is raised by means of the lifting gears 17 to a position above the molding flask 10 so that the tensioning elements 29 are also raised. This will permit filling of the mold flask. The tensioning element 29 of the pressure means 27 are at this point balanced and will bear in their rear positions upon the frame 20. In this position of the apparatus, the molding flask 10 is placed in an exact location over the pattern plate 8 and the sand frame 22 is attached upon the molding flask 10. Subsequently, the molding flask 10 is filled with a dosed amount of molding sand 21.

Figure 3:
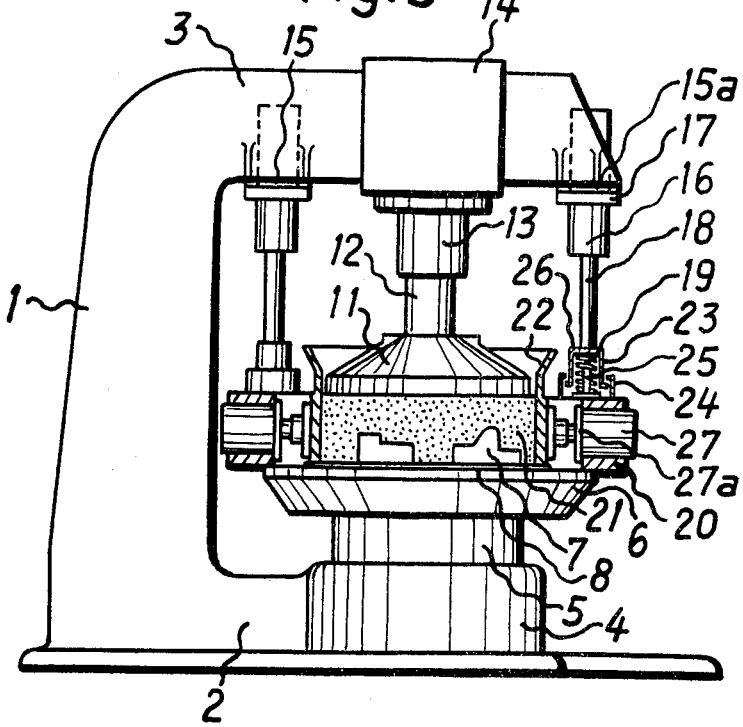
FIG. 3 is an elevational view partially in section similar to the view of FIG. 1 and taken along the line I—I of FIG. 2 showing the frame in the lowered position.
Figure 4:
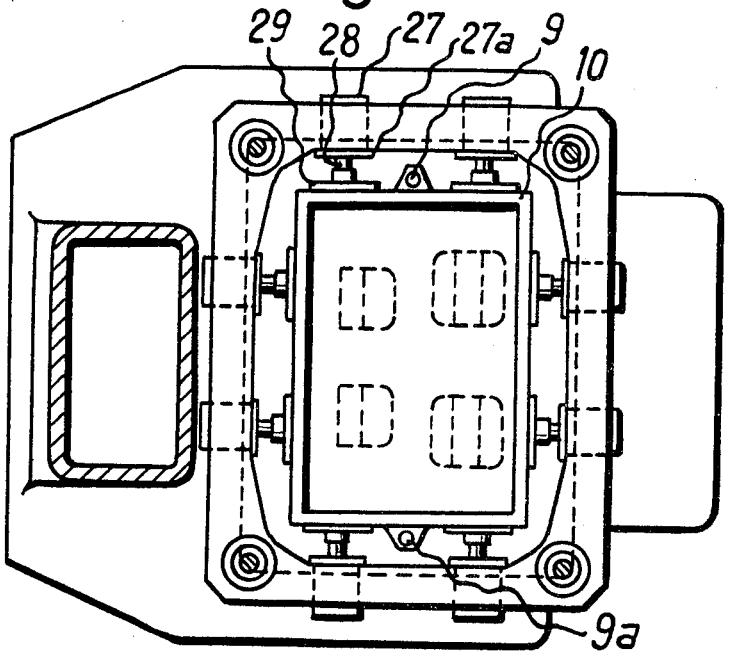
FIG. 4 is a top view of the device shown in FIG. 3 with the frame in the lowered position.

In a subsequent molding operation, which is depicted in FIGS. 3 and 4, the molding sand which is to form the casting mold is compressed by the press plate 11. At the same time, the frame 20 is lowered so that it will extend about the molding flask 10 located upon the mold table 6. In this position, the frame 20 is displaceably held by the pendulum device 19 so that it bears upon the mold table 6. With the frame 20 appropriately positioned, thereby effecting appropriate positioning of the tensioning elements 29, a fluid pressure medium such as pressure oil is introduced under synchronous control to the pressure cylinder **27*a* so that the tensioning elements 29 will be forced to bear against the molding flask 10. Since the flask 10 is relatively rigidly connected with the mold table 6 in this position, the frame 20 will be centered over the tensioning elements 29 by the molding flask 10** so that the pressure means, which are at this time acting under pressure, will operate uniformly to apply compressive forces upon the molding flask walls.

Subsequently, a fluid pressure medium such as pressure oil is fed to the feed cylinder 13 thereby causing the press plate 11 to be thus lowered onto the casting mold which is to be produced in order to compress the molding sand 21. For the final compression of the casting mold, a pressure medium such as pressure oil is fed to the compression cylinder 4. The pressure which exerted by the mold compression unit upon the molding sand 21 results in creating in the mold forces extending transverse to the walls of the molding flask. These transverse forces are in a relative relationship to the compression pressure of the mold compression unit and thus the compression unit in a relative relation to the deformation of the molding box. That is, the pressure applied to the sides of the flask is so controlled that the magnitude of the forces of the pressure applied are related to the magnitude of the forces applied by the compression unit which is operated to compress the molding sand.

By means of control elements (not shown) of a central control device, the pressure of the pressure medium which is fed to the pressure means 27 is regulated in relationship to the compression pressure applied to the molding sand so that the pressure acting upon the walls of the mold flask is brought practically to a state of equillibrium thereby effecting the development of an equillibrium in the geometric form of the molding box. This enables the configuration of the molding box to be stabilized and to be maintained constant to a fairly great extent.

Figure 5:
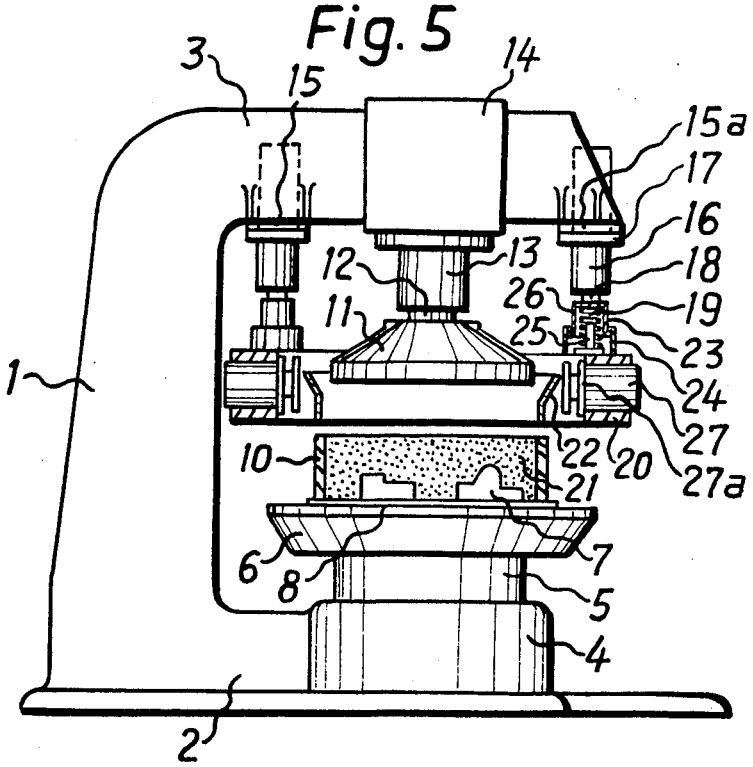
FIG. 5 is an elevational view partially in section similar to the view of FIG. 1 and showing the same device during a stage of operation where the casting mold is fully compressed, the view being again taken along the line I—I of FIG. 2.
Figure 6:
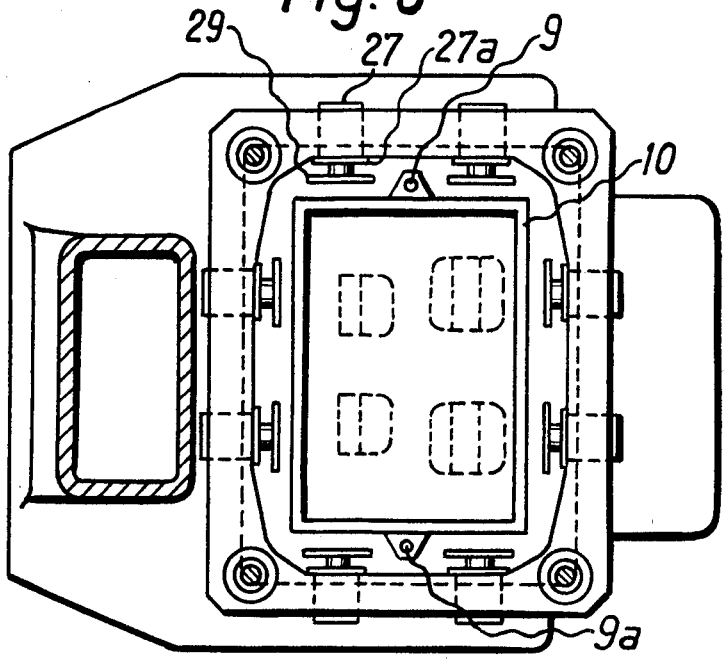
FIG. 6 is a top view of the device of FIG. 5 wherein the casting mold is fully compressed.

In another molding operation represented in FIGS. 5 and 6, the casting mold is fully compressed and is ready for transportation to another station for further treatment. In this molding operation, the press plate 11 as well as the sand frame 22 are raised above the molding flask 10 and the frame is similarly brought to a position above the molding flask 10 after the tensioning elements 29 have been relieved and set back to their original positions. The compression cylinder 4 is balanced and the mold table 6 is ready to receive another molding flask after transferring the finished casting mold. Thus, the starting position for the molding operation represented in FIGS. 1 and 2 is once again obtained.

The cycle of operation may then be repeated in the manner previously described.

The advantages provided by the present invention consist in the fact that lightweight, relative inexpensive molding boxes or flasks which require only simple transporting devices may be used while at the same time providing assurance that sufficient rigidity and stability of form for the molding flasks are obtained. Due to the use of the adjustable tensioning elements which operate as stabilizing means for the configuration of the molding flasks, it is also possible to utilize molding flasks having outside dimensions which may vary within wide limits. That is, the apparatus will be versatile in that molding flasks of different sizes may be interchangeably utilized. Furthermore, the energy which is dissipated during the pressing of the molding compound may be fully utilized in the edge zones for compressing the molding compound thereby creating a uniform compressive effect so that molds which are free of offset may be obtained. A further advantage is that mold ball ruptures will be positively avoided.

While a specific embodiment of the invention has been shown and described in detail to illustrate the application of the inventive principles, it will be understood that the invention may be embodied otherwise without departing from such principles.

I claim:

1. In mold forming apparatus including means for compressing molding sand contained in mold flasks, the improvement comprising stabilizing means for counteracting the effects of compression forces generated within said mold flasks during compression of said molding sand tending to cause distortion of said flasks, said stabilizing means comprising a movable frame adapted to extend about a molding flask placed in said apparatus for compression of molding sand contained therein, lifting gear for adjustably positioning said frame relative to a molding flask placed in said apparatus, a plurality of fluid pressure actuated tensioning elements mounted on said frame and movable therewith, said tensioning elements being adapted to apply compressive forces inwardly of said molding flask upon the walls of said flask, and pressure means for applying fluid pressure to said tensioning means to effect application thereby of said compressive forces against said molding flask in relation to the magnitude of the forces created within the flask by compression of the molding sand contained therein by said mold sand compressing means.

2. Apparatus according to claim 1 wherein said lifting gear is operated by means of a fluid pressure medium.

3. Apparatus according to claim 2 wherein said lifting gear includes piston rod means, said piston rod means being articulated to said movable frame.

4. Apparatus according to claim 1 wherein said movable frame is so arranged as to be capable of being centered by a molding flask.

5. Apparatus according to claim 1 wherein said pressure means comprise fluid pressure cylinders which are mounted in said movable frame.

6. Apparatus according to claim 1 wherein said tensioning elements are movably connected with said pressure means.

* * * * *